US007975327B2

(12) United States Patent
Switzer

(10) Patent No.: US 7,975,327 B2
(45) Date of Patent: Jul. 12, 2011

(54) SUBMERSIBLE TABLE AND SEAT ASSEMBLY FOR USE IN A SWIMMING POOL

(76) Inventor: Charles W. Switzer, Lake Station, IN (US)

( * ) Notice: Subject to any disclaimer, the term of this patent is extended or adjusted under 35 U.S.C. 154(b) by 1131 days.

(21) Appl. No.: 11/697,458

(22) Filed: Apr. 6, 2007

(65) Prior Publication Data

US 2007/0236060 A1 Oct. 11, 2007

Related U.S. Application Data

(60) Provisional application No. 60/744,371, filed on Apr. 6, 2006.

(51) Int. Cl.
*E04H 4/00* (2006.01)

(52) U.S. Cl. ..... 4/496; 441/130

(58) Field of Classification Search ..... 4/496, 541.6; 297/157.1, 170; 441/129, 130
See application file for complete search history.

(56) References Cited

U.S. PATENT DOCUMENTS 4,776,046 A * 10/1988 Newberry et al. ..... 4/541.6
5,465,677 A * 11/1995 Alter ..... 441/129
6,209,147 B1 * 4/2001 Wheaton ..... 4/496
6,808,434 B1 * 10/2004 Park ..... 441/130

* cited by examiner

*Primary Examiner* — Tuan N Nguyen
(74) *Attorney, Agent, or Firm* — Hartman & Hartman, P.C.; Gary M. Hartman; Domenica N. S. Hartman

(57) ABSTRACT

A submersible table and seat assembly suitable for use in a swimming pool. The submersible assembly includes a base, a table, and seats. The base has a hollow interior capable of being filled with a flowable material in an amount sufficient to enable the submersible assembly to rest on the bottom of the swimming pool. The table and the seats are supported on the base and adjustably connected to the base to enable the table and seats to be raised and lowered relative to the base, so that the table and the seats are adjustable to accommodate varying depths of the swimming pool. Fluid passages are present within the base and/or the seats, jets are fluidically coupled to the fluid passages, and a conduit is connected to the fluid passages for flowing a pressurized fluid through the jets.

20 Claims, 2 Drawing Sheets

SUBMERSIBLE TABLE AND SEAT ASSEMBLY FOR USE IN A SWIMMING POOL

CROSS REFERENCE TO RELATED APPLICATIONS

This application claims the benefit of U.S. Provisional Application No. 60/744,371, filed Apr. 6, 2006, the contents of which are incorporated herein by reference.

BACKGROUND OF THE INVENTION

The present invention generally relates to outdoor furniture, and more particularly to tables and seats configured for use with swimming pools and other bodies of water.

Various furniture pieces have been proposed for use in and around pools. For example, U.S. Pat. No. 4,776,046 to Newberry et al. discloses a table installed on a hot tub, and supported by the edge of the tub. The pedestal of the table can be equipped with water jets fed with water from the water return of the tub. U.S. Pat. No. 6,571,403 to Wheaton discloses a table adapted to be attached to a submerged surface of a swimming pool and equipped with floating chairs. In contrast to Wheaton, U.S. Pat. No. 6,808,434 to Park and U.S. Pat. No. 6,878,026 to Cloutier disclose floating tables, with Park's table being self-stabilized as a result of being partially filled with water.

BRIEF SUMMARY OF THE INVENTION

The present invention provides a submersible table and seat assembly suitable for use in swimming pools and other water bodies. The submersible assembly includes a base, a table, and seats. The base has a hollow interior capable of being filled with a flowable material in an amount sufficient to enable the submersible assembly to rest on the bottom of the swimming pool. The table and seats are supported on the base and adjustably connected to the base to enable the table and seats to be raised and lowered relative to the base, so that the table and the seats are adjustable to accommodate varying depths of the swimming pool. Fluid passages are present within the base and/or seats, jets are fluidically coupled to the fluid passages, and a conduit is connected to the fluid passages for flowing a pressurized fluid through the jets.

Objects and advantages of this invention will be better appreciated from the following detailed description.

DETAILED DESCRIPTION OF THE INVENTION

Figure 1:
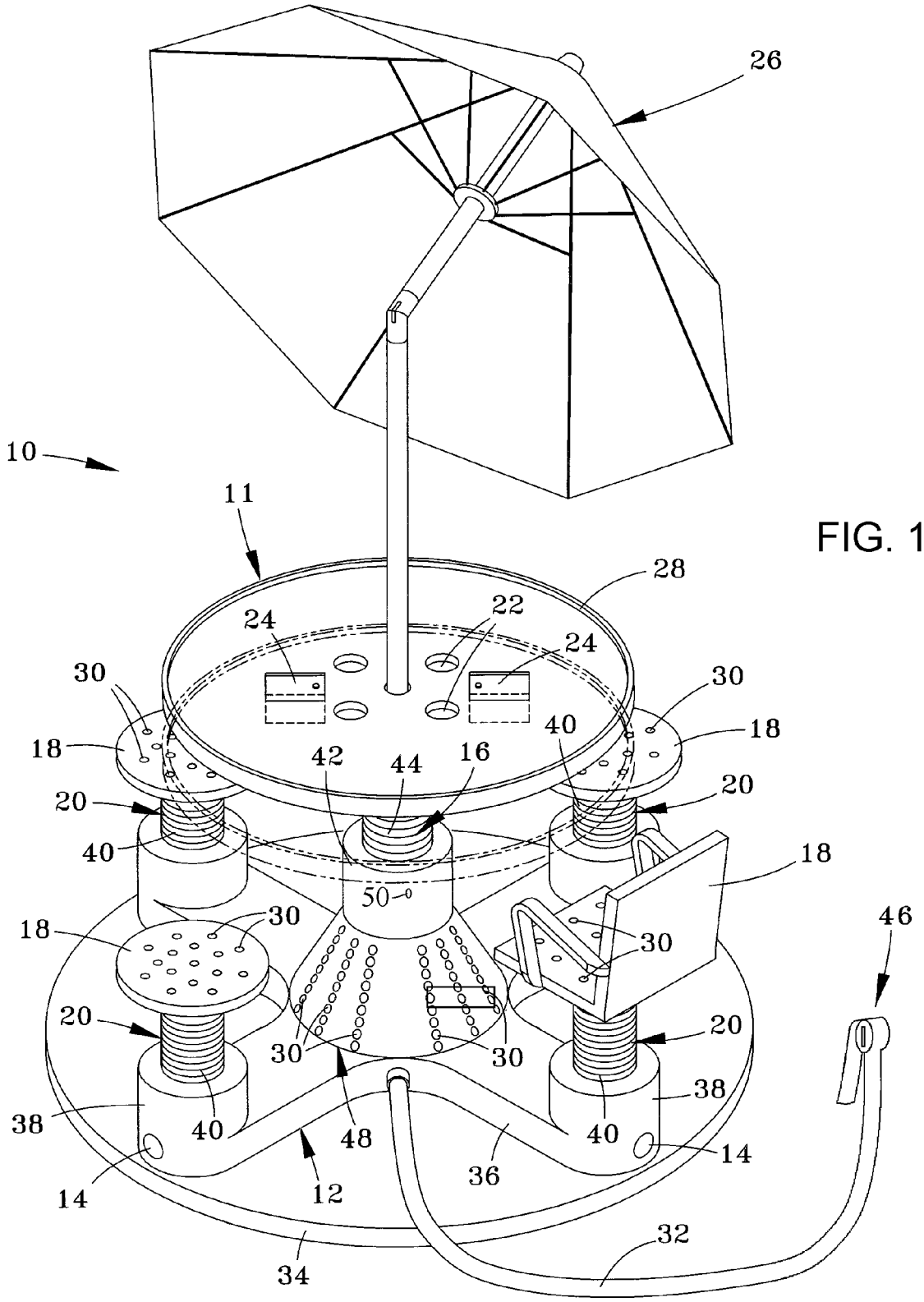
FIG. 1 is a perspective view of a submersible table and seat assembly for use in a swimming pool in accordance with a preferred embodiment of this invention.

FIG. 1 schematically represents a submersible table and seat assembly 10 configured in accordance with a preferred embodiment of the invention. The submersible assembly 10 is particularly intended for use in swimming pools, and more particularly when partially submerged in a pool. However, it is foreseeable that the submersible assembly 10 could be used in other bodies of water, including lakes, rivers, etc. The assembly 10 is represented as including a table 11, a base 12, and several seats 18, all preferably interconnected to form a unitary assembly. While particular seat designs are represented in FIG. 1, the invention is not so limited, in that the seats 18 can have or lack backs, have a solid or hollow plastic construction, have mesh-type flexible cushions, etc.

The base 12 is preferably hollow with several holes that can be fluidically sealed with drain plugs 14 after filling the hollow interior of the base 12 with a suitable flowable material, preferably water though other materials are possible including other liquids and granular materials, for example, sand. Taking into consideration the size of the hollow interior within the base 12, the table 11, base 12, and seats 18 are formed of materials whose densities are chosen so that once the interior of the base 12 is filled, the submersible assembly 10 is sufficiently heavy to rest on the bottom of the swimming pool while the base 12 and seats 18 are below and the table 11 is above the water level in the pool. If necessary, the assembly 10 can further include removable weights (not shown) placed on the base 12 or within compartments of the base 12, or permanent weights built into the base 12. For durability, at least the outer surfaces of the assembly 10 are preferably formed of weather, chemical, and corrosion-resistant materials, including but not limited to plastic materials.

As indicated in FIG. 1, the table 11 and seats 18 are preferably adjustable so that their heights can be adjusted to accommodate varying water depths, as well as various sizes of individuals and individual preferences as to how much of an individual's body is submerged in the pool. As shown, the table 11 and seats 18 are individually and separately connected to the base 12, though it is foreseeable that the table 11 and seats 18 could be interconnected to be raised and lowered in unison. In the embodiment of FIG. 1, the table 11 and seats 18 are represented as being adjustably connected to the base 12 with threaded connections 16 and 20. The table 11 is formed to have a support post 44 whose lower end is threaded into a complementary threaded boss 42 extending upward from the center of the base 12. Similarly, each seat 18 is formed to have a support post 40 whose lower end is threaded into a complementary threaded boss 38 extending upward from an arm 36 radiating from the center of the base 12. To prevent the table 11 from turning during use, FIG. 1 represents a pin 50 inserted through the boss 42 of the base 12 to engage the support post 44 of the table 11.

As also represented in FIG. 1, the base 12 further includes a raised, sloping footrest 48 accessible to the feet of occupants in the seats 18. The seats 18 and footrest 48 are equipped with fluid jets 30 that are fluidically connected to a supply hose 32 via fluid passages (now shown) within the base 12 and seats 18. The fluid passages can be formed in any suitable manner, such as hoses or pipes routed through the seats 18 and the hollow interior of the base 12, or passages molded or otherwise integrally formed within the base 12 and seats 18. The supply hose 32 is equipped with a connection 46 that enables the hose 32 to be connected to a nozzle or other part of the water return system of the pool filtration system. The connection 46 is represented as having a switch that enables users to select whether the water from the return system flows to the submersible assembly 10 to provide a massage effect when discharged through the jets 30, or flows directly into the pool thus bypassing the assembly 10, or a combination thereof. Alternatively, the connection 46 could be configured to couple the jets 30 to another fluid source, for example, from a heated water source separate from the pool filtration system.

The assembly 10 is further represented as having additional desirable features, including cup holders 22 configured as recesses in the top of the table 11, closable storage compartments 24 that can serve as built-in coolers for the table 11, an umbrella 26 releasably connected to the table 11, and a raised lip 28 along the perimeter of the table 11 to prevent liquid spills from flowing into the swimming pool. The closures for the compartments 24 preferably slide into pocket recesses within the table 11. To increase their capacity, the storage compartments 24 can protrude below the lower surface of the table 11. Lastly, the submersible assembly 10 is shown as resting on a mat 34 whose material, thickness, and size are preferably chosen to protect the bottom of the swimming pool.

Figure 2:
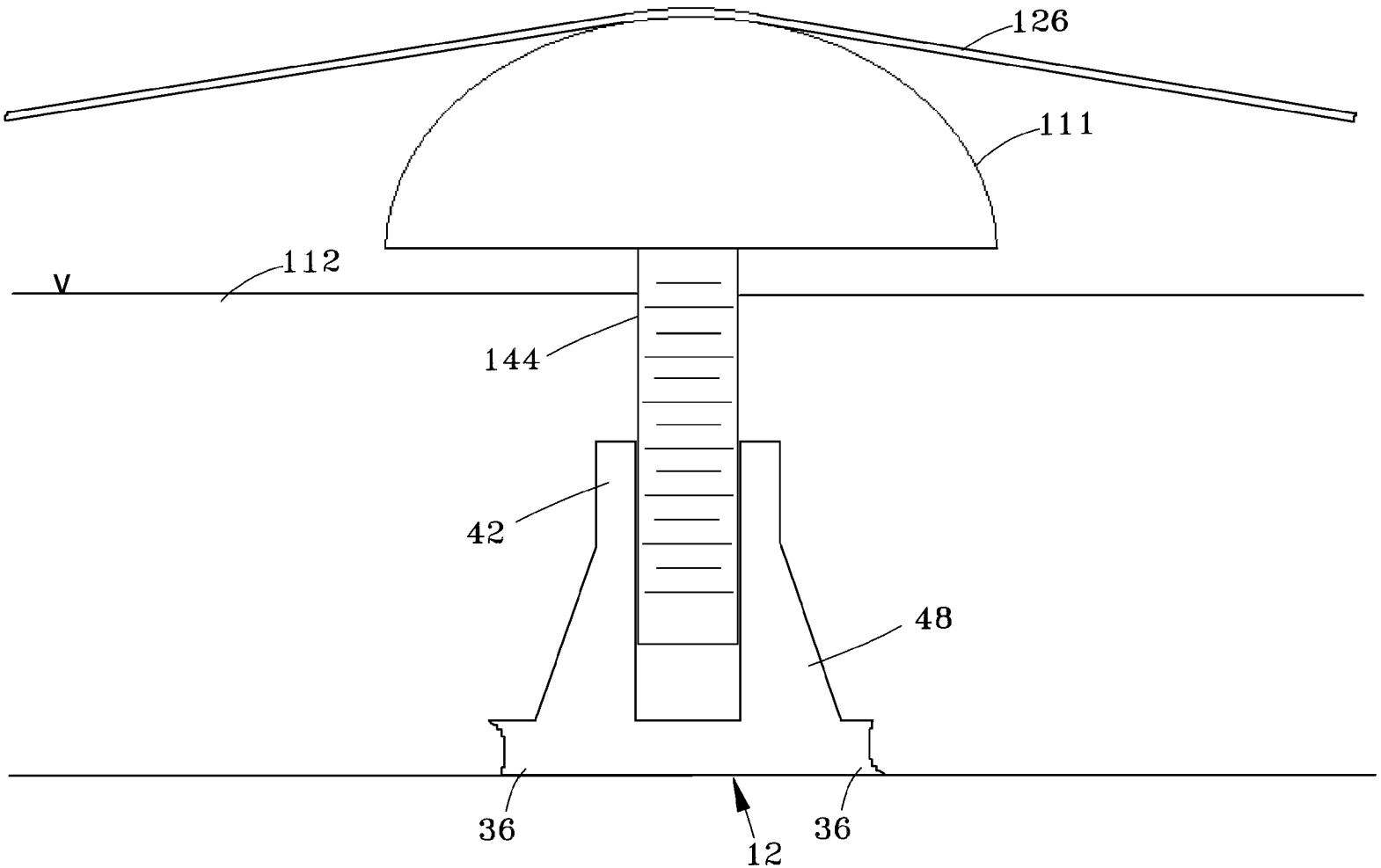
FIG. 2 is a schematic cross-sectional view of the submersible table and seat assembly of FIG. 1 converted for storage within a swimming pool in accordance with a preferred aspect of this invention.

Finally, FIG. 2 shows a manner in which the submersible assembly 10 can be converted to support a pool cover 126 when the pool is closed for the season. In FIG. 2, the table 11 has been replaced by a plug 111 with a rounded head that supports the pool cover 126 above the surface of the water 112 within the pool. The plug 111 has a threaded post 144 that threads into the boss 42 of the base 12 in the same manner as the threaded post 44 of the table 11. A suitable diameter for the plug 111 is believed to be approximately that of the table 11, though lesser and greater diameters would also be suitable. The rounded shape of the plug 111 is preferred (but not required) to minimize the likelihood of tearing or snagging the pool cover 126 when installing the cover 126, as well as minimize the likelihood of damaging the cover 126 over extended periods.

Suitable dimensions for the submersible assembly 10 can vary widely. In one embodiment, the table 11 has a diameter of about four feet (about 1.2 meters) and a vertical thickness of about two inches (about five centimeters), the base 12 has a width (tip-to-tip of the arms 36) of about five to about six feet (about 1.5 to about 2 meters), the table 11 has a vertical adjustment capability of about 3.5 to about 5 feet (about 1 to about 1.5 meters) from the bottom of the base 12, and the seats 18 have a vertical adjustment capability of about 2 to about 3.5 feet (about 0.5 to about 1 meter) from the bottom of the base 12.

While the invention has been described in terms of a preferred embodiment, it is apparent that other forms could be adopted by one skilled in the art. For example, the physical configuration of the assembly 10 and its individual components (11, 12, 18, etc.) could differ from those shown, the table 11, base 12, seats 18, could be individually formed as unitary bodies (e.g., injection molded) or as assemblies, and materials other than those noted could be use. Furthermore, each of the components of the assembly 10 could be constructed as subassemblies to enable the assembly 10 to be more completely disassembled for ease of transport and storage. Therefore, the scope of the invention is to be limited only by the following claims.

The invention claimed is:

1. A submersible table and seat assembly for use in a swimming pool, the table and seat assembly comprising:

a base having a hollow interior capable of being filled with a flowable material in an amount sufficient to enable the table and seat assembly to rest on the bottom of the swimming pool;

a table supported on the base and adjustably connected to the base to enable the table to be raised and lowered relative to the base;

seats supported on the base and adjustably connected to the base to enable the seats to be raised and lowered relative to the base;

fluid passages within at least one of the base and the seats;

jets fluidically coupled to the fluid passages; and a conduit connected to the fluid passages for flowing a pressurized fluid through the jets;

wherein the table and the seats are adjustable to accommodate varying depths of the swimming pool.

2. The submersible table and seat assembly according to claim 1, wherein the table and the seats are individually and separately adjustably connected to the base.

3. The submersible table and seat assembly according to claim 1, further comprising means for adjustably connecting the table to the base, the connecting means comprising a threaded post extending downward from the table and a complementary threaded boss extending upward from the base.

4. The submersible table and seat assembly according to claim 3, further comprising means for replacing the table and supporting a pool cover above the base and seats.

5. The submersible table and seat assembly according to claim 4, wherein the supporting and replacing means comprises a plug having a threaded post complementary to the threaded boss of the base and a rounded upper surface adapted for contacting and supporting the pool cover.

6. The submersible table and seat assembly according to claim 1, further comprising means for adjustably connecting each of the seats to the base, each of the connecting means comprising a threaded post extending downward from one of the seats and a complementary threaded boss extending upward from the base.

7. The submersible table and seat assembly according to claim 1, wherein the base comprises a raised footrest portion accessible to the feet of occupants of the seats.

8. The submersible table and seat assembly according to claim 7, wherein the jets are present within the footrest portion of the base.

9. The submersible table and seat assembly according to claim 1, wherein the fluid passages are present within each of the base and the seats.

10. The submersible table and seat assembly according to claim 1, wherein the jets are present within each of the base and the seats.

11. The submersible table and seat assembly according to claim 1, wherein the fluid passages and the jets are present within each of the base and the seats.

12. The submersible table and seat assembly according to claim 1, further comprising a mat sized to be placed between the base and the bottom of the swimming pool.

13. The submersible table and seat assembly according to claim 1, further comprising cup holders configured as recesses in the table.

14. The submersible table and seat assembly according to claim 1, further comprising storage compartments configured as closable recesses in the table.

15. The submersible table and seat assembly according to claim 1, further comprising an umbrella releasably connected to the table.

16. The submersible table and seat assembly according to claim 1, further comprising a raised lip along a perimeter of the table to prevent liquid spills on the table from flowing into the swimming pool.

17. The submersible table and seat assembly according to claim 1, further comprising means fluidically coupled to the conduit for bypassing the fluid passages.

18. The submersible table and seat assembly according to claim 1, further comprising means for fluidically sealing the hollow interior to prevent the flowable material from being released into the swimming pool.

19. The submersible table and seat assembly according to claim 1, wherein the base, the table, and the seats are formed of materials whose densities enable the table and seat assembly to rest on the bottom of the swimming pool when the hollow interior is filled with water.

20. The submersible table and seat assembly according to claim 1, further comprising means for replacing the table and supporting a pool cover, the supporting and replacing means having a low extremity adapted for connection to the base and a rounded upper surface adapted for contacting and supporting the pool cover.

* * * * *